United States Patent [19]

Turner

[11] 3,974,619

[45] Aug. 17, 1976

[54] ALIGNMENT CLIP FOR REGLETS

[75] Inventor: Norman G. Turner, Lake Bluff, Ill.

[73] Assignee: Superior Concrete Accessories, Inc., Des Plaines, Ill.

[22] Filed: June 26, 1975

[21] Appl. No.: 590,626

[52] U.S. Cl. ..... 52/726; 52/58; 52/364; 403/300

[51] Int. Cl.[2] ..... E04C 3/30; E04D 1/36

[58] Field of Search ..... 52/726, 718, 58, 758 C, 52/760, 658, 364; 403/300, 303, 286, 338, 405, 363

[56] References Cited

UNITED STATES PATENTS

| | | | |
|---|---|---|---|
| 1,053,173 | 2/1913 | Hilgendorf | 403/300 |
| 1,970,422 | 8/1934 | Foster | 52/726 |
| 2,916,113 | 12/1959 | Lee | 52/760 X |
| 3,168,798 | 2/1965 | Berg | 52/364 X |
| 3,241,271 | 3/1966 | Berg | 52/58 |
| 3,251,103 | 5/1966 | Saut | 52/718 X |
| 3,900,269 | 8/1975 | Pavlot | 403/363 |

*Primary Examiner*—J. Karl Bell
*Attorney, Agent, or Firm*—Norman H. Gerlach

[57] ABSTRACT

An alignment clip adapted for use in aligning two like reglets in end-abutting relation, such reglets each comprising a channel component including a bight portion and two flanges extending from opposite longitudinal edges of the bight portion and converging outwardly therefrom, said clip comprising a body portion adapted to overlie the adjacent ends of the bight portions of two abutting reglets, and flange means on opposite longitudinal edges of the body portion for engaging the reglet flanges to hold the reglets in alignment, such flange means including a snap-on flange.

2 Claims, 5 Drawing Figures

ALIGNMENT CLIP FOR REGLETS

BACKGROUND OF THE INVENTION

This invention relates to the installation of reglets which are employed in concrete construction for securing flashing or frames in place. Most particularly, the invention relates to a clip adapted for use in aligning reglets in end-abutting relation and to an assembly of the clip and the reglets.

The use of reglets for installation of counterflashing, window frames and the like in cast-in-place concrete construction is well-known, and is disclosed, for example, in U.S. Pat. Nos. 3,168,798, 3,246,433, 3,319,384, and 3,512,318. The reglets are constructed or rolled or extruded metal, and, more recently, extruded plastic. Accurate alignment of end-abutting reglets or reglet sections has been accomplished by the use of splines, such as disclosed in U.S. Pat. Nos. 3,246,433 and 3,512,318. In the former patent, the reglets are required to have certain structural features for cooperation with the spline. In the latter patent, the spline is inserted in telescopic fashion within adjacent ends of the reglets, requiring, therefore, that the reglets be devoid of any filling at their ends.

In the copending U.S. patent application of Edward T. Berg for "Reglet Structure," Ser. No. 570,590, filed Apr. 23, 1975 as a continuation of application Ser. No. 462,301, filed Apr. 19, 1974, there is disclosed an improved reglet structure which preferably is filled with a sealing compound to preclude the entry of moisture. U.S. Pat. No. 3,168,798 discloses another reglet construction similarly filled with sealing compound. In practice, the reglets are filled with the sealing compound at the place of manufacture and are shipped in prefilled condition to their places of use. As a result, there is no room for insertion of splines within the alignment purposes, and, moreover, the loss of sealing compound which would result from insertion of a spline or the like may open the reglets to the entry of moisture. Consequently, there is a need for new and improved means for aligning the reglets, preferably not requiring additions to or alterations of the existing reglet structure. A compelling need for alignment means exists with respect to the structure of the aforesaid copending application of Berg, in view of the narrowness of the opening provided for insertion of counterflashing into the reglet, which opening must be in near-perfect alignment with the corresponding openings in adjacent neglets.

SUMMARY OF THE INVENTION

The present invention provides an alignment clip adapted for use in aligning two like reglets in end-abutting relation, such reglets each comprising a channel component including a bight portion and two flanges extending from opposite longitudinal edges of the bight portion and converging outwardly therefrom, said clip comprising a body portion adapted to overlie the adjacent ends of the bight portions of two abutting reglets, and flange means on opposite longitudinal edges of the body portion for engaging the reglet flanges to hold the reglets in alignment, such flange means including a snap-on flange. The invention also provides an assembly of the alignment clip and reglets of the foregoing description, which preferably includes a sealer filling in each of the reglets.

The new alignment clip provides near-perfect alignment of end-abutting reglets, being especially useful with reglets of the structure disclosed in the aforesaid application of Berg, and also with other reglets, for example, with reglets of the type disclosed in U.S. Pat. No. 3,168,798.

The alignment clip is adapted for fitting on the reglets without need for alteration of the reglet structure in order to cooperate with the clip. The clip is constructed for snapping on the ends of abutting reglets, being emplaced either by finger pressure or by a hammer blow. At times, it will be convenient to merely slide the clips on the reglet ends and bring the ends together in engagement with the clip.

The alignment clip is relatively small, simple and economical, yet is sufficiently strong and rigid to provide and maintain correct alignment of the reglets.

BRIEF DESCRIPTION OF THE DRAWINGS

The attached drawings illustrate a preferred embodiment of the invention, without limitation thereto. In the drawings, like elements are identified by like reference symbols in each of the views, and.

DESCRIPTION OF THE PREFERRED EMBODIMENT

Figure 1:
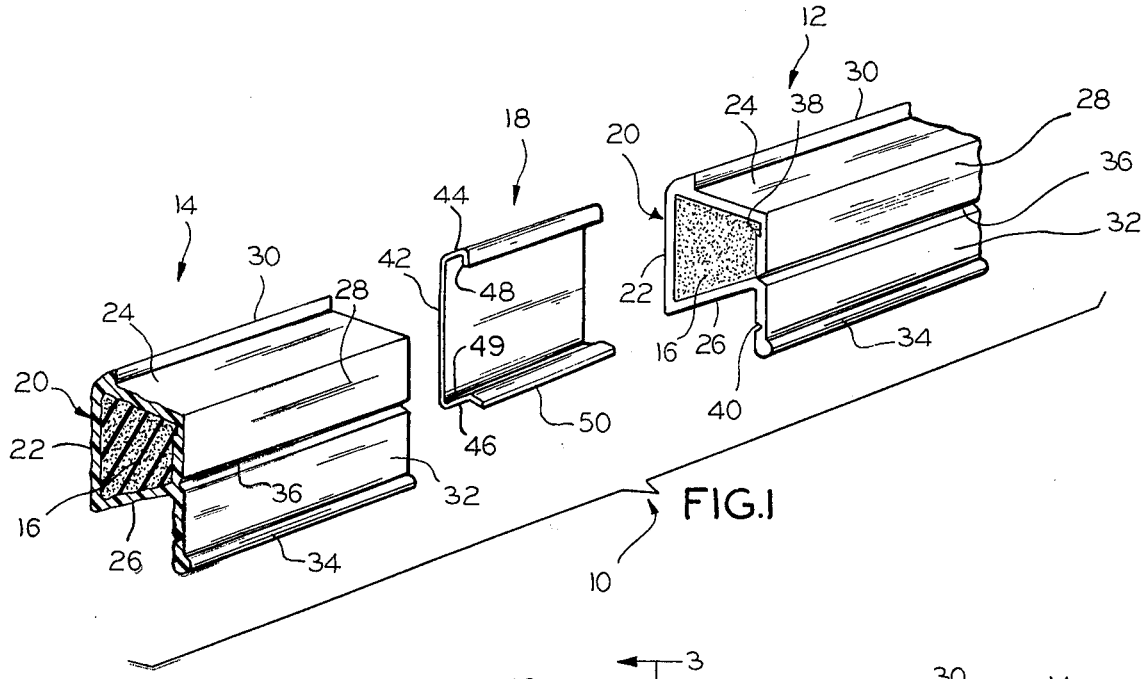
FIG. 1 is an exploded perspective fragmentary view of an aligned filled reglet assembly according to the invention, illustrating portions of two reglets and an alignment clip for aligning the reglets in end-abutting relation.

Referring to the drawings, an aligned filled reglet assembly 10 according to the invention includes a first reglet 12, a second and like reglet 14, a sealer filling 16 in each of the reglets, and an alignment clip 18. The reglets 12 and 14 are in end-abutting relation, and the alignment clip 18 bridges the joint between the adjacent ends of the reglets.

The reglets 12 and 14, with slight modification, the same as the reglet disclosed in the above-identified application of Berg. Each of the reglets 12 and 14 is of tubular construction and embodies a channel component 20 including a substantially flat, elongated, rectangular bight portion or web 22, a flat, elongated, rectangular so-called upper flange or wall 24, and a flat, elongated, rectangular so-called lower flange or wall 26, the two flanges extending forwardly from opposite longitudinal edges of the bight portion therealong and converging outwardly therefrom. Each reglet 12 and 14 also includes an elongated, rectangular apron or front wall 28 which, with exceptions noted hereinafter, is flat and parallel to the bight portion 22. An elongated anchoring rib or flange 30 of substantially traiangular cross section extends outwardly from the upper flange 24 adjacent the bight portion 22 of each of the reglets 12 and 14. A substantially flat, elongated mounting lip or flange 32 extends from the lower flange 26 with its outer surface substantially coplanar with the outer surface of the apron 28. An elongated bead 34 projects outwardly from the outer edge of the mounting lip 32 therealong.

The foregoing components of the reglets 12 and 14 is the preferred illustrative embodiment of the invention are integrally extruded in one piece of rigid thermoplastic resin, such as polyvinyl chloride. A V-shaped severing groove 36 is formed in the outer surface of the apron 28 along its junction with the lip 32, adjacent the lower flange 26. A generally rectangular hinge groove 38 is formed on the inner surface of the apron 28 along its junction with the upper flange 24. A nail-locating groove 40 is formed on the inner surface of the lip 32 and extends longitudinally thereof intermediate its longitudinal edges.

The clip 18 includes a substantially flat, rectangular body portion 42, a hook-like or C-shaped flange 44 on one longitudinal edge of the body portion, and a "N"-shaped undulatory flange 46 on the opposite longitudinal edge of the body portion. The clip 18 is of one-piece contruction, preferably of stiff spring metal, and the flanges 44 and 46 thereof are integral with the body portion 42 along the longitudinal edges thereof. The body portion 42 is adapted to overlie closely the adjacent ends of the bight portions 22 of the abutting reglets 12 and 14. The clip flanges 44 and 46 extend forwardly from the edges of the body portion 42 and are adapted for engaging the reglet flanges 24 and 26 to hold the reglets in alignment. More particularly, the hook-like clip flange 44 is adapted for attaching the clip 18 to the anchoring ribs 30 of the reglets 12 and 14, the flange 44 terminating in an inturned hooking lip 48 for such attachment. The undulatory clip flange 46 serves as a snap-on flange, it being adapted for snapping the clip 18 on the lower flange 26 of each reglet. The undulatory flange 46 includes an inner section 49 that extends inwardly and forwardly from the body portion 42, and an outer section or lip 50 that extends outwardly and forwardly from the inner section 49, forming an inwardly pointed V-outline therewith. The outer section 50 serves to spread the undulatory flange 46 when the clip 18 is applied to the reglets, as described hereinafter. With the clip 18 in place on the reglets, the inner section 49 engages the lower flange 26 of each reglet.

The reglets 12 and 14 preferably are supplied by the manufacturer with the filling 16 in the channel component 20 and covered and protected therein by the apron 28. The filling may be, for example, butyl rubber sealer, which forms a moisture-proof seal with flashing inserted in the reglet and has other desirable physical properties. To retain the filling in the reglets during shipment and storage, and prior to use, plastic tape or the like may be applied to the ends of the reglets, the tape being removed just prior to installation.

Figure 2:
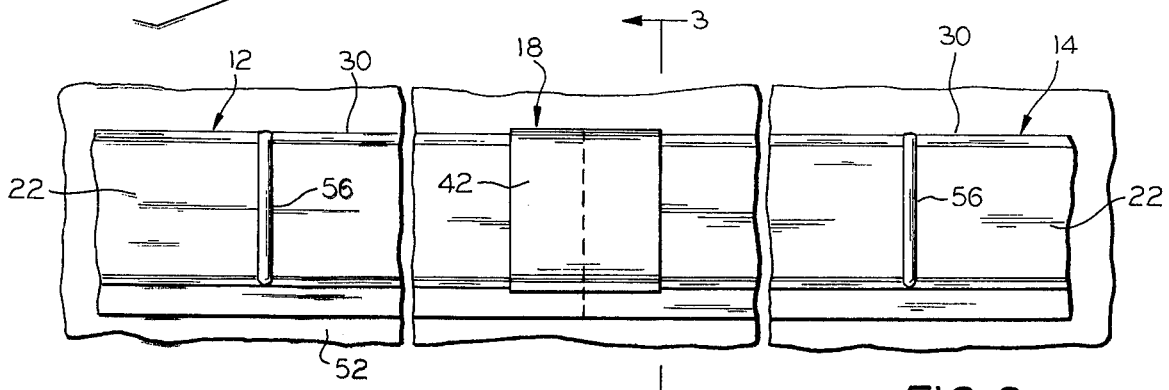
FIG. 2 is an elevational assembled fragmentary and broken view of the elements illustrated in FIG. 1, showing the reglet assembly as installed, the view being taken from the back side with respect to the view of FIG. 1.
Figure 3:
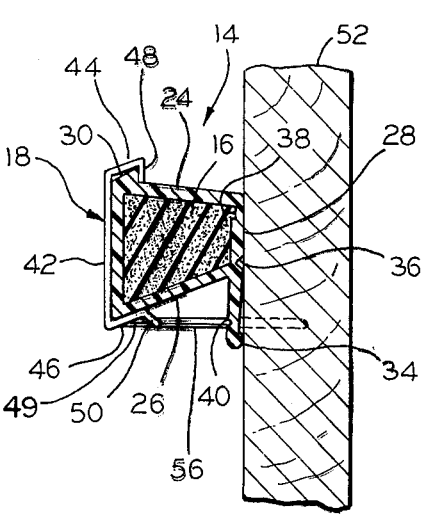
FIG. 3 is a cross sectional view of the reglet assembly, taken substantially on line 3—3 of FIG. 2.
Figure 4:
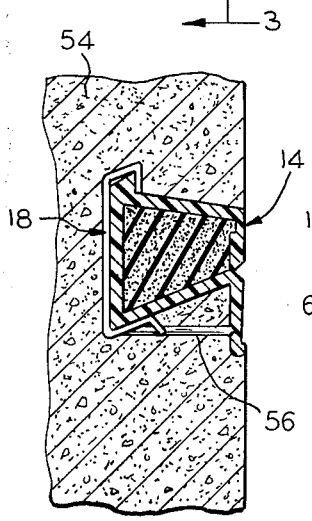
FIG. 4 is a view similar to FIG. 3, but illustrating the appearance of the reglet assembly after casting a concrete wall therearound and removing the concrete form.

The reglets 12 and 14 are assembled on a wooden wall or panel 52 of a concrete form, in the manner illustrated in FIGS. 2 and 3. In the illustrations, the form wall 52 is vertical, for pouring a vertical concrete wall, parapet or the like 54. In such construction, the reglets 12 and 14 extend horizontally, hence the reference to the "upper" flange 24 and the "lower" flange 26, which have such relative dispositions. In mounting the reglets, it is recommended that guide lines be drawn on the form wall 52 and guide nails be placed therealong, to serve as temporary support for the reglets. The first reglet 12 is aligned on the guide nails, and secured to the form wall 52 by J-typenails 56, the head portions of which extend over the bight portion 22 and the rib 30 of the reglet, and the shanks of which are driven through the locating groove 40 in the mounting lip 32. Owing to the presence of the bead 34, the surface of the reglet adjacent the form wall 52 is tightly pressed against the surface of the form wall, to minimize seepage of mortar therebetween, as more particularly described in U.S. Pat. No. 3,168,798.

The second reglet 14 is brought up to the first reglet 12, and their adjacent ends are butted together. The alignment clip 18 then is snapped in place over the abutting reglet ends. The clip is attached by placing the hook-like flange 44 over the reglet ribs 30, generally as illustrated in FIG. 3, and exerting pressure on the body portion 42 sufficient to cause the outer section 50 of the undulatory flange 46 to engage the adjacent edge of the bight portion 22 and cause the undulatory flange to spread outwardly and move into engagement with the lower reglet flange 26, as illustrated in FIG. 3. In this manner, the reglet flanges 24 and 26 are firmly engaged by the clip flanges 44 and 46, to hold the reglets in alignment. At times, it may be possible to slip the alignment clip 18 over the end of the first reglet 12, to the extent illustrated in FIG. 2, and then slide the end of the second reglet 14 into the clip, until the reglets are abutting. With the second reglet 14 thus aligned with the first reglet 12, the second reglet is secured in place by additional nails 56.

Concrete is poured in the form, around the reglet assembly 10. When the concrete has set, the form wall 52 is removed from the concrete wall 54. The projecting ends of the nails 56 may be cut off. Roofing paper 58 is laid and extended up the wall 54 to a location adjacent to the reglets. Counterflashing 60 then is secured in place over the upper ends of the roofing paper 58, to prevent the access of moisture thereto. Such counterflashing may include an upstanding covering panel 62, an integral spacer panel 64 extending over the top of the roofing paper, and a downwardly inclined lip 66.

Figure 5:
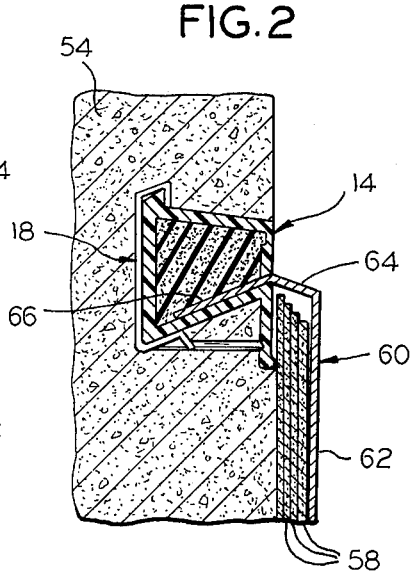
FIG. 5 is a view similar to FIG. 4 additionally illustrating attachment of roofing paper and counterflashing to the wall, the lip of the counterflashing being inserted in the reglet and held thereby.

For the purpose of installing the counterflashing 60, the apron 28 of each reglet is cut with a knife along the severing groove 36. The apron 28 then may be swung inwardly and upwardly to a slight extent, bending along the hinge groove 38. The apron 28 is restricted in its movement by its inherent rigidity and by the presence of the filling 16 within the reglet. Accordingly, there is but a relatively narrow opening for insertion of the flashing lip 66 along the severing groove 36. Therefore, it is important that the alignment clip 18 hold the reglets 12 and 14 in nearperfect alignment. The lip 66 is inserted into the reglets, as illustrated in FIG. 5, and the apron 28 serves to hold the lip and thus the flashing 60 in place, with the filling 16 forming a seal with the lip.

When the reglet assembly 10 is installed as illustrated in the drawings, the rib 30 of each reglet serves to anchor the reglet in the concrete wall 54, particularly when the concrete is green and the form wall 52 is removed. The rib 30 also acts as a barrier to penetration of water which may gain access to the top of the upper flange 24.

As indicated, hereinabove, the reglet assembly 10 also may be employed for other purposes, and, in particular, for mounting window frames. For example, reglets such as the illustrative members 12 and 14 may be employed with a concrete window sash form, in the manner illustrated in U.S. Pat. No. 3,512,318. In such application, where the reglets extend both vertically and horizontally, the reglet ribs 30 are arranged so that ultimately, they will be on the outside of the window, where they assist in preventing entry of moisture. The alignment clip 18 finds important application in bridging the joints between abutting reglets or reglet sections in this application of reglets as well.

When the reglet assembly 10 is employed for mounting a window frame, it is preferable to remove the apron 28 from each of the reglets 12 and 14 after casting the concrete, to provide room for insertion of the window frame flange. The apron 28 may be removed by cutting along both the severing groove 36 and the hinge groove 38, for a distance sufficient to permit a good manual grip on the severed portion, and then stripping or tearing the apron from the remainder of the reglet.

The principles of the invention are applicable similarly to other reglet structures or designs, whether or not the reglets are filled with a sealing compound. For example, an alignment clip according to the invention, which may be similar to or a modification of the illustrative clip 18, may be employed in like manner with the reglet construction illustrated in U.S. Pat. No. 3,168,798.

While a preferred embodiment of the invention has been illustrated and described, it will be apparent to those skilled in the art that various other changes and modifications may be made in such embodiment within the spirit and scope of the invention. It is intended that all such changes and modifications be included within the scope of the appended claims.

Having thus described the invention, what I claim as new and desire to secure by letters patent is:

1. An aligned filled reglet assembly which comprises two like and similarily oriented reglets in end-abutting relation, a sealer filling in each of said reglets, and an alignment clip bridging the joint between the adjacent ends of said reglets, each of said reglets comprising a channel component including a bightportion and two flanges extending from opposite longitudinal edges of the bight portion and converging outwardly therefrom, an anchoring rib extending outwardly from one of said flanges of each reglet adjacent the bight portion thereof, an apron bridging the space between the outer ends of and connecting said reglet flanges, and means providing a longitudinal groove in said apron and adjacent to one of said reglet flanges, whereby said apron may be slit along said groove and swung slightly inwardly to permit entry into the channel component of the lip of lip-equipped flashing said clip comprising a body portion adapted to overlie the adjacent ends of the bight portions of said reglets, and flange means on opposite longitudinal edges of said body portion for engaging said reglet flanges to hold said reglets in alignment, said flange means including a hooklike flange on one longitudinal edge of said body portion for attaching the clip to said anchoring ribs, and an undulatory flange on the opposite longitudinal edge of said body portion for snapping the clip on the flange of each reglet opposite to the reglet flange from which said anchoring rib extends.

2. An aligned reglet assembly which comprises two like and similarly oriented reglets in end-abutting relation, and an alignment clip bridging the joint between the adjacent ends of said reglets, each of said reglets comprising a channel component including a bight portion and two flanges extending forwardly from opposite longitudinal edges of the bight portion and converging outwardly therefrom, and an anchoring rib extending outwardly from one of said flanges of each reglet adjacent to the bight portion thereof, said clip comprising a substantially flat body portion adapted to overlie closely the adjacent ends of the bight portions of said reglets, and flange means extending forwardly from opposite longitudinal edges of said body portion for engaging said reglet flanges to hold said reglets in alignment, said flange means including a coextensive hook-like flange formed on one longitudinal edge of said body portion and terminating in an inturned hooking lip for attaching the clip to the adjacent end portions of said anchoring ribs, and a V-shaped undulatory flange on the opposite longitudinal edge of said body portion for snapping the clip on the adjacent and portions of the flanges of the reglets opposite to the reglet flanges from which said anchoring ribs extend, said undulatory flange including an inner section extending inwardly and forwardly from said body portion and engaging said adjacent and portions of the opposite reglet flanges, and an outer section extending outwardly and forwardly from said inner section and forming an inwardly pointed V-outline therewith, said outer section engaging the adjacent end portions of said reglet bight portions to spread out undulatory flange for snapping the clip in place.

* * * * *